US006617835B2

(12) United States Patent
Nishimura

(10) Patent No.: US 6,617,835 B2
(45) Date of Patent: Sep. 9, 2003

(54) MOS TYPE REFERENCE VOLTAGE GENERATOR HAVING IMPROVED STARTUP CAPABILITIES

(75) Inventor: Masato Nishimura, Ibaraki-ken (JP)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/140,378

(22) Filed: May 6, 2002

(65) Prior Publication Data

US 2003/0006746 A1 Jan. 9, 2003

(30) Foreign Application Priority Data

May 7, 2001 (JP) ..... 2001-136503

(51) Int. Cl.[7] ..... G05F 3/16
(52) U.S. Cl. ..... 323/313; 323/315; 323/901
(58) Field of Search ..... 323/313, 315, 323/901

(56) References Cited

U.S. PATENT DOCUMENTS 5,030,903 A * 7/1991 Bernard et al. ..... 323/901
5,144,223 A * 9/1992 Gillingham ..... 323/313
RE34,772 E * 11/1994 Bernard et al. ..... 323/901
5,486,787 A * 1/1996 Maekawa et al. ..... 323/315
5,929,622 A * 7/1999 Kardash ..... 323/315
6,392,394 B1 * 5/2002 Nakagawa et al. ..... 323/313

* cited by examiner

*Primary Examiner*—Jeffrey Sterrett
(74) *Attorney, Agent, or Firm*—William B. Kempler; W. James Brady, III; Frederick J. Telecky, Jr.

(57) ABSTRACT

A reference voltage generator having high-speed starting at a low power source voltage and with high stability and high precision, without substantially increasing the circuit area. NMOS transistors 10 and 12 form a current mirror circuit, with the same drain current I. PMOS transistors 14 and 16 form a current mirror circuit, and drain current I is fed to the current mirror circuit. Resistor 18 provides an offset between the source voltages of PMOS transistors 14 and 16. Start-up capacitor 22 is connected between gate/drain of NMOS transistor 10, which is connected as a diode, and the terminal of power source voltage $V_{DD}$ on the positive electrode side. And/or a start-up capacitor 24 is connected between gate/drain of diode-connected PMOS transistor 16 and the terminal of power source voltage $V_{SS}$ on the negative electrode side. In another embodiment PMOS transistors 25, 26 form a current mirror with the same drain current I. NMOS transistors 21, 23 form a current mirror and the drain current I is fed to the current mirror circuit. Resistor 28 provides an offset to the terminal of power source $V_{SS}$. Start-up capacitor 32 is connected between the gate/drain of PMOS transistor 25 and Vss.

13 Claims, 7 Drawing Sheets

MOS TYPE REFERENCE VOLTAGE GENERATOR HAVING IMPROVED STARTUP CAPABILITIES

FIELD OF THE INVENTION

The present invention pertains to a reference voltage generator that generates a bias voltage or another prescribed reference voltage. In particular, the present invention pertains to a MOS type reference voltage generator.

BACKGROUND OF THE INVENTION

For example, when a constant-current source is used in an analog circuit, it is necessary to apply a bias voltage or reference voltage at a prescribed voltage level from a reference voltage generator to the constant-current source.

FIG. 15 is a schematic diagram illustrating the circuit configuration of a typical conventional reference voltage generator. This reference voltage generator is composed of a pair of NMOS transistors 100, 102, a pair of PMOS transistors 104, 106, and resistor 108. The two NMOS transistors 100, 102 form a current mirror circuit, and output terminal 110 is led out from the drain of the NMOS transistor on one side, e.g., NMOS transistor 102.

At steady state, various MOS transistors 100–106 operate in saturation mode. If the current that flows through two NMOS transistors 100, 102 of the current mirror circuit is I, the voltage between the gate and source of PMOS transistor 104 is Vgs1, and the resistance of resistor 108 is R, then reference voltage $V_{ref}$ obtained at output terminal 110 will be given by formula (1):

$$Vref=V_{DD}-(I\cdot R+Vgs1) \quad (1)$$

Also, current I is given by following formula (2).

$$I=(I^{1/2}/K2^{1/2}-I^{1/2}/KI^{1/2})/R \quad (2)$$

where, K1 and K2 are given by following formulas (3) and (4), respectively.

$$K1=\mu C_{OX}(W1/L1)/2 \quad (3)$$

$$K2=\mu C_{OX}(W2/L2)/2 \quad (4)$$

where, W1 and L1 represent the channel width and channel length of PMOS transistor 104, respectively, and W2 and L2 represent the channel width and channel length of PMOS transistor 106, respectively.

For this reference voltage generator, when the power is turned on, a small leakage current flows through various MOS transistors 100–106 between the terminal of power source voltage $V_{DD}$ on the positive electrode side and the terminal of power source voltage $V_{SS\ on}$ the negative electrode side. As a result, the gate voltage of PMOS transistors 104 and 106 gradually decreases, while the gate voltage of NMOS transistors 100 and 102 gradually increases. Consequently, once the gate voltage of said MOS transistors 100–106 reaches a potential that permits the flow of a certain drain current, the mode shifts instantly to the saturation region, and the stable operating point can be reached.

However, the aforementioned starting method that primarily depends on the leakage current of the MOS transistors requires a relatively long time from power on to reach the desired output voltage (reference voltage) $V_{ref}$. As a result, this constitution is inconvenient for applications that require immediate operation directly after power on and for applications that require immediate switching from power save mode (stand-by mode) to operating mode.

In order to solve this problem, in the prior art, as shown in FIG. 16, a start-up circuit made up of NMOS transistor 112 connected as a diode is connected between the gate/drain of PMOS transistor 106 and the gate/drain of NMOS transistor 100. Due to this start-up circuit, immediately after power on, current flows from the gate/drain side of PMOS transistor 106 to the gate/drain side of NMOS transistor 100 through NMOS transistor 112. As a result, it is possible to reduce the time required for MOS transistors 100–106 to shift to the stable operating point in the saturation region.

However, for the aforementioned start-up circuit made up of active element (MOS transistor 112, not only is the circuit area significantly increased, but also the off requirements after the end of start-up become very strict, which is undesired. That is, in the stable operating state after start-up, in order to hold the off state of MOS transistor 112, the difference in potential between two nodes n1 and n2 must be higher than threshold voltage Vt of MOS transistor 112. It is very difficult to meet this off requirement in practical applications. In particular, it is almost impossible when a low power source voltage is adopted.

The purpose of this invention is to solve the aforementioned problems of the conventional methods by providing a type of reference voltage generator that can perform high-speed start-up with high stability.

Another purpose of this invention is to provide a reference voltage generator that has a start-up circuit which can be used even with a low power source voltage, without significantly increasing the circuit area.

SUMMARY OF THE INVENTION

In accordance with one aspect of the invention, a reference voltage generator has a MOS transistor which has its gate and drain short circuited to each other and has its source connected to a first power source voltage terminal that provides a first potential, a capacitor connected between the gate/drain of the aforementioned MOS transistor and a second power source voltage terminal that provides a second potential, and an output terminal connected to a prescribed node of the circuit; the aforementioned MOS transistor operates in saturation mode, and a reference voltage at a prescribed level is output from the aforementioned output terminal.

With the aforementioned constitution, when the power is turned on, due to the capacitive coupling of the capacitor, the potential at the gate/drain of the MOS transistor connected as a diode is pulled towards the side of the power source voltage opposite to the source side. As a result, the MOS transistor quickly reaches a stable operating point in the saturation region, and the overall circuit start-up time can be reduced.

For the reference voltage generator of the present invention, it is preferred that the constitution have a current mirror circuit for having a prescribed current flow in the aforementioned MOS transistor and the aforementioned node. As an embodiment in this case, the aforementioned current mirror circuit may contain the aforementioned MOS transistor.

As a preferred embodiment of the reference voltage generator in this invention, the constitution has the following parts: a first MOS transistor of a first conductivity type that has its gate and drain short-circuited to each other and has its source connected to a first power source voltage terminal that provides a first potential, a second MOS transistor of a first conductivity type that has its gate connected to the gate of the aforementioned first MOS transistor and has its source connected to the aforementioned first power source voltage terminal so as to form a current mirror circuit together with the aforementioned first MOS transistor, a third MOS transistor of the second conductivity type that has its drain connected to the drain of the aforementioned first MOS transistor and has its source connected to the second power source voltage terminal that provides the second potential, a fourth MOS transistor of the second conductivity type that has its drain connected to the drain of the aforementioned second MOS transistor and has its source connected to the aforementioned second power source voltage terminal, an offset circuit for providing voltage offsets to the gate-source voltage of the aforementioned third MOS transistor and the aforementioned fourth MOS transistor, respectively, a capacitor connected between the gate/drain of the aforementioned first MOS transistor and the aforementioned second power source voltage terminal, and a reference voltage output terminal connected to the drain of the aforementioned first MOS transistor or the aforementioned second MOS transistor.

As a modified embodiment of the aforementioned embodiment, the constitution may have a capacitor connected between the gate/drain of the aforementioned fourth MOS transistor and the aforementioned first power source voltage terminal instead of, or in addition to, the capacitor connected between the gate/drain of the aforementioned first MOS transistor and the aforementioned second power source voltage terminal.

In the aforementioned embodiments, it is preferred that the gates of the aforementioned third MOS transistor and the aforementioned fourth MOS transistor that perform the offset function be connected together, and that the gate and drain of the aforementioned fourth MOS transistor be short-circuited. Also, the following constitution is preferred: the gate of the aforementioned third MOS transistor is connected to the drain of the aforementioned fourth MOS transistor, and the gate of the aforementioned fourth MOS transistor is connected to the source of the aforementioned third MOS transistor.

For the reference voltage generator of this invention, it is preferred that the aforementioned offset circuit contain a resistor connected between the aforementioned second power source voltage terminal and the source of the aforementioned third MOS transistor or the source of the aforementioned fourth MOS transistor.

REFERENCE NUMERALS AND SYMBOLS AS SHOWN IN THE DRAWINGS

In the FIGS, 10, 12, 20, 22, 30 and 32 represent an NMOS transistor, 14, 16, 24, 26, 44 and 46 a PMOS transistor, 18, 28, and 48 a resistor, 20, 30 and 50 an output terminal, and 22, 24, 32 and 52, a start-up capacitor.

DESCRIPTION OF EMBODIMENTS

In the following, a preferred embodiment of this invention will be explained with reference to FIGS. 1–14.

Figure 1:
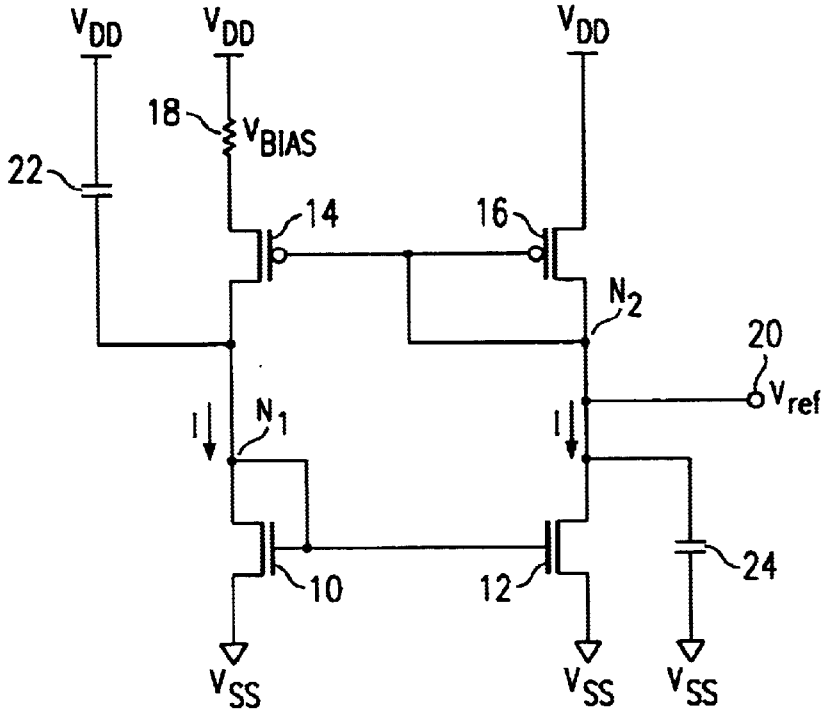
FIG. 1 is a circuit diagram illustrating the constitution of the reference voltage generator in an embodiment of this invention.

FIG. 1 illustrates the constitution of the reference voltage generator in an embodiment of this invention. This reference voltage generator has a pair of NMOS transistors 10, 12, a pair of PMOS transistors 14, 16, resistor 18, and capacitors 22, 24.

Two NMOS transistors 10 and 12 form a current mirror circuit that have the same drain current I. More specifically, the side of NMOS transistor 10 is connected as a diode, that is, the gate is short-circuited to the drain, and the source is directly connected to the terminal of power source voltage $V_{SS\ on}$ the negative electrode side, and the side of NMOS transistor 12 is connected to the gate of NMOS transistor 10, and its source is directly connected to the terminal of power source voltage $V_{SS\ on}$ the negative electrode side.

PMOS transistors 14 and 16 form a current mirror circuit, with drain current I fed to the current mirror circuit. PMOS transistor 16 is connected as a diode, that is, the gate is short-circuited to the drain, and the source is directly connected to the terminal of power source voltage $V_{DD\ on}$ the positive electrode side. The gate/drain of PMOS transistor 16 are connected to the drain of NMOS transistor 12, and output terminal 20 is fed out from the connecting point or from node N2. The gate of PMOS transistor 14 is connected to the gate of PMOS transistor 16, and the drain is connected to the gate/drain of NMOS transistor 10, while the source is connected via resistor 18 to the terminal of power source voltage $V_{DD}$ on the positive electrode side.

Resistor 18 is a voltage offset or bias means. Due to the voltage drop (RI) on this resistor 18, a voltage offset is generated between the gate and source of PMOS transistors 14 and 16, and, output voltage $V_{ref}$ having a voltage level corresponding to the offset is obtained at node N2.

In this embodiment, capacitors 22 and 24 form a start-up circuit. More specifically, capacitor 22 is connected between the gate/drain of NMOS transistor 10 and the terminal of power source voltage $V_{DD}$ on the positive electrode side. When power is turned ON, due to capacitive coupling of the capacitor, the gate/drain of NMOS transistor 10 is pulled up to the side of $V_{DD}$, so that the shift to the operating point in the saturation region of NMOS transistor 10 is accelerated.

Also, capacitor 24 is connected between gate/drain of PMOS transistor 16 connected as a diode and the terminal of power source voltage $V_{SS}$ on the negative electrode side, and, when power is turned on, due to the capacitive coupling of the capacitor, the gate/drain of PMOS transistor 16 is pulled down to the side of $V_{SS}$, so that the shift to the operating point in the saturation region of PMOS transistor 16 is accelerated.

Figure 2:
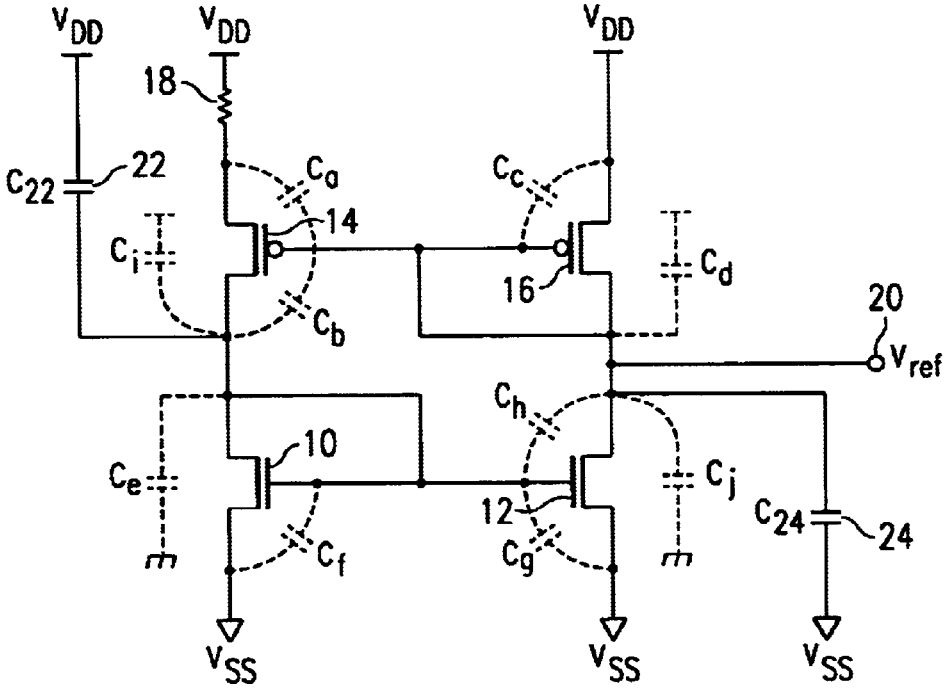
FIG. 2 is a diagram illustrating the parasitic capacitances of the various portions in the reference voltage generator in the embodiment.

FIG. 2 illustrates the parasitic capacitance in various portions of the aforementioned reference voltage generator. PMOS transistor 14 contains gate-source capacitance Ca, gate-drain capacitance Cb, and drain-substrate junction capacitance Ci. PMOS transistor 16 contains gate-source capacitance Cc and drain-substrate junction capacitance Cd. NMOS transistor 10 contains drain-substrate junction capacitance Ce and gate-source capacitance Cf. NMOS transistor 12 contains gate-source capacitance Cg, gate-drain capacitance Ch, and drain-substrate junction capacitance Cj. Also, since the gates and drains of diode-connected NMOS transistor 10 and PMOS transistor 16 are short-circuited, the gate-drain capacitance here can be ignored.

Of the aforementioned parasitic capacitances, Ca, Cb, Cc, and Cd counteract capacitance C24 of start-up capacitor 24, while Ce, Cf, Cg and Ch counteract capacitance C22 of start-up capacitor 22. Here, parasitic capacitances Ci and Cj have a complementary relationship with capacitances C22 and C24 of the capacitors, respectively.

Figure 3:
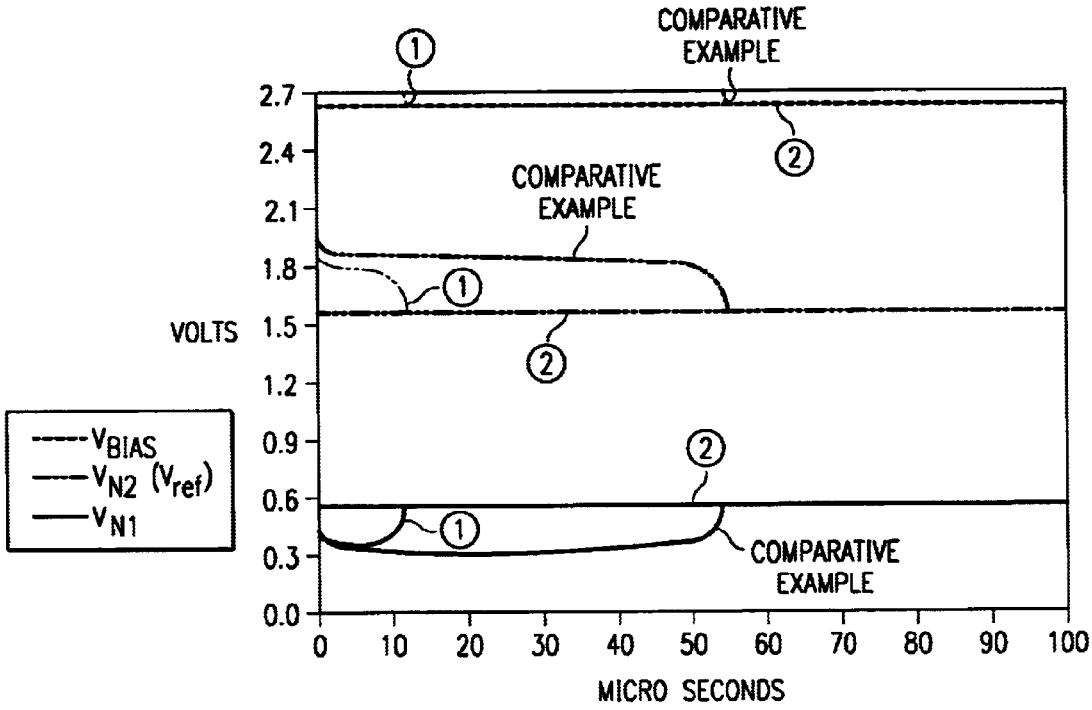
FIG. 3 is a diagram illustrating the voltage waveforms of the various portions of the reference voltage generator in the embodiment at the time of start-up.
Figure 4:
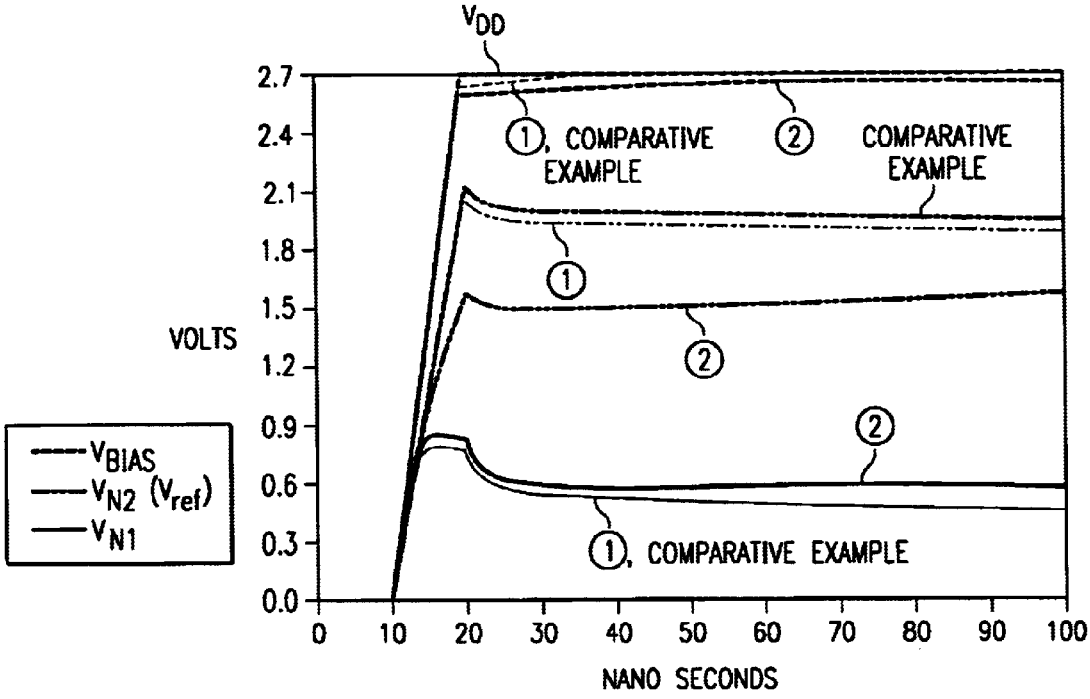
FIG. 4 is a diagram illustrating the voltage waveforms of the various portions of the reference voltage generator in the embodiment immediately after start-up, with the time axis expanded.

FIG. 3 illustrates the voltage waveforms (simulation) of the various portions in this reference voltage generator in start-up mode (0–100 $\mu$s). FIG. 4 illustrates the voltage waveforms of the various portions immediately after start-up (0–100 ns), with the time coordinate expanded for clarity. In the figures, $V_{N1}$ and $N_{N2}$ are the potentials at nodes N1 and N2, respectively, and $V_{BIAS}$ is the source potential of PMOS transistor 14 under the voltage offset effect of the resistor. $V_{N2}$ is also an output voltage ($V_{ref}$). Power source voltage $V_{DD}$ on the positive electrode side is set to 2.7 V, and power source voltage $V_{SS\ on}$ the negative electrode side is set to 0 V.

The voltage waveforms illustrated in the figures correspond to the case when capacitances C22 and C24 of capacitors 22 and 24 are set to 0.01 pF, respectively (Application Example ①) and the case when they are set at 0.1 pF (Application Example ②). As a comparative example, the voltage waveform corresponds to the case when capacitors 22 and 24 are not attached.

Also, in this simulation, the following values are selected as the various parasitic capacitances. The values of parasitic capacitances Ca, Cb, Cc, Cd that counteract capacitor 24 are as follows.

Ca=24 fF
Cb=24 fF
Cc=5 fF
Cd=42 fF Sum 95 fF=0.095 pF

The values of parasitic capacitances Ce, Cf, Cg, Ch that counteract capacitor 22 are as follows.

Ce=24 fF
Cf=5 fF
Cg=5 fF
Ch=5 fF Sum 39 fF=0.039 pF

The values of parasitic capacitances Ci and Cj of capacitors 22 and 24 are as follows.

Ci=191 fF
Cj=24 fF

As shown in FIG. 3, in this embodiment, due to presence of start-up capacitors 22 and 24, the time required for voltages at various nodes $V_{N1}$ and $V_{N2}$ to reach the desired stable level after power on, that is, the time required for the drain voltage of various MOS transistors 10–16 to reach the stable operating point in the saturation region (start time), can be significantly reduced. That is, when capacitors 22 and 24 for start-up are not connected (comparative example), the start time is about 55 $\mu$s. on the other hand, in Application Example ① (C22=0.01 pF), the start time is reduced to about 12 $\mu$s. In Application Example ② (C22=0.1 pF), it is reduced to about 20 ns (or more correctly, to 10 ns).

Now, the operation of the various portions in start-up mode of the reference voltage generator will be examined in more detail. First of all, the operation will be examined when start-up capacitors 22 and 24 are not connected with respect to the voltage waveforms shown in FIGS. 5 and 6 corresponding to the comparative example shown in FIGS. 3 and 4.

Figure 5:
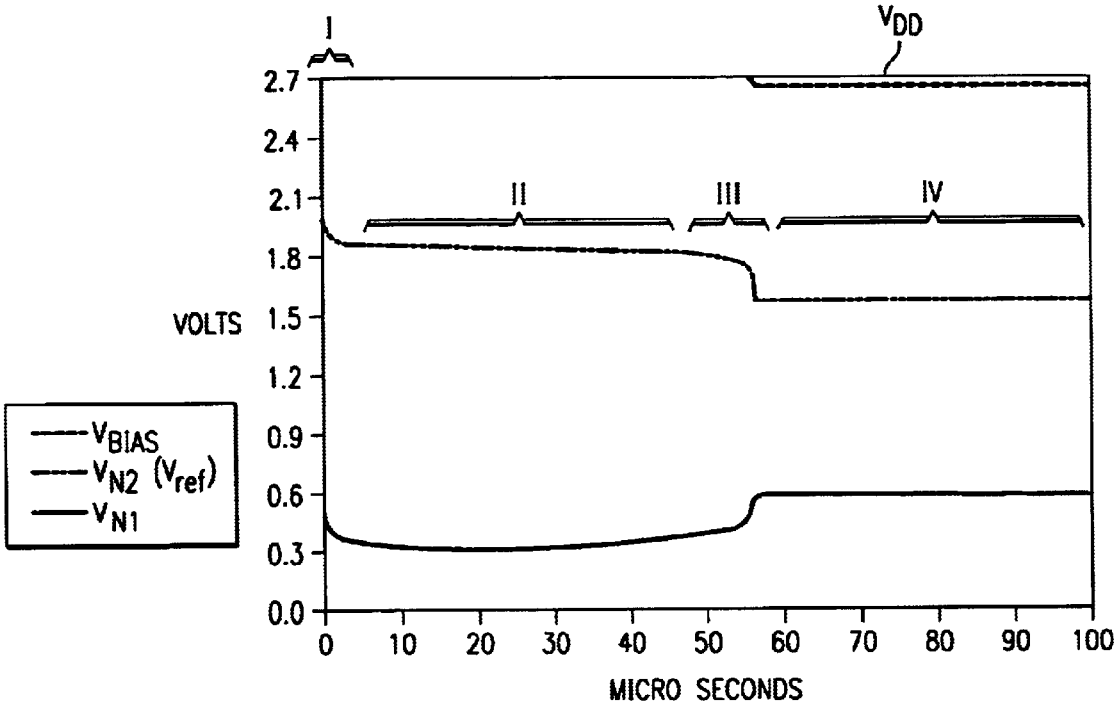
FIG. 5 is a diagram illustrating the function of the reference voltage generator in the embodiment at the time of start-up.

As shown in FIG. 5, in start-up mode, the state in each portion makes stepwise change or transition in the order of phases I, II, III and IV.

Figure 6:
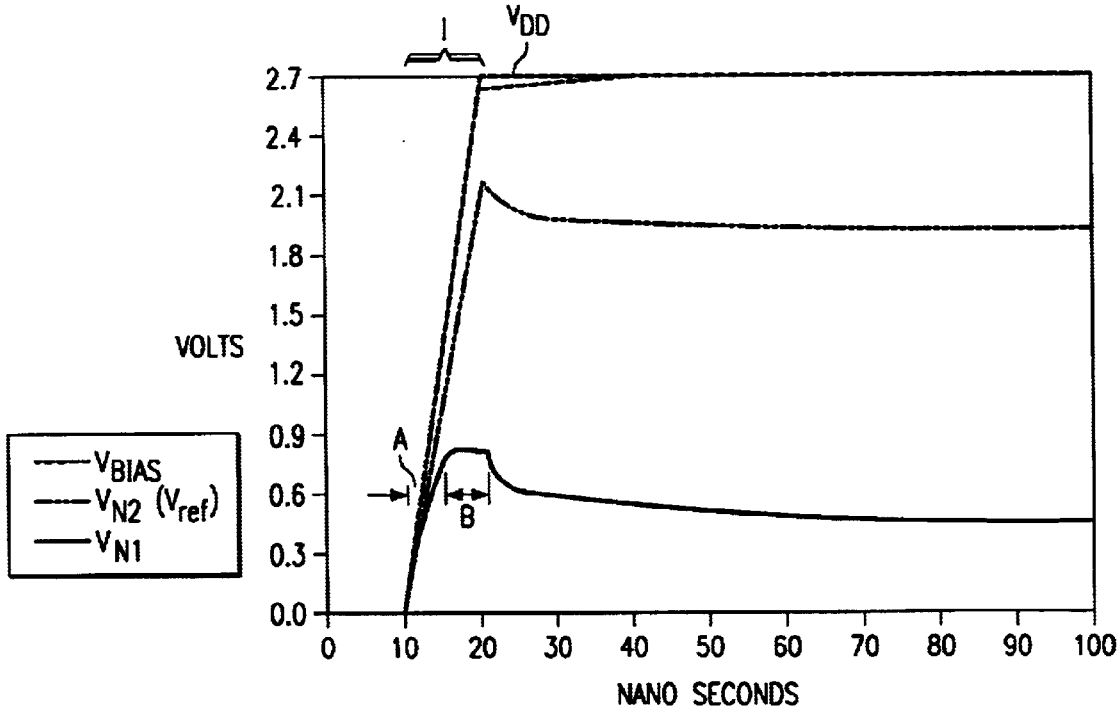
FIG. 6 is a diagram illustrating the function of the reference voltage generator in the embodiment immediately after start-up.

As shown in FIG. 6, in phase I immediately after power on, due to the capacitive coupling of parasitic capacitances Ca, Cc, Cd, potential $V_{N2}$ (Vref) of node N2 is pulled up to about 2.1 V, together with a rise in power source voltage $V_{DD}$. Because potential $V_{N2}$ of node N2 is the potential of gate/drain of PMOS transistor 16, rise of this potential $V_{N2}$ acts to hold PMOS transistor 16 in the off state.

On the other hand, on the side of PMOS transistor 14, due to the small current flowing in resistor 18 for charging said parasitic capacitances Ca, Cc, Cd, source potential $V_{BIAS}$ is raised to a level (about 2.6 V) that is slightly lower than power source voltage $V_{DD}$ (by the voltage drop on resistor 18).

Because NMOS transistor 10 is off, due to the capacitive coupling of parasitic capacitance Ci, potential $V_{N1}$ of node N1 is raised (state A). However, when it is raised by a certain amount (about 0.8 V), NMOS transistor 10 starts to turn on, so that the rise in potential $V_{N1}$ stops, and a balanced state (state B) is achieved. That is, it becomes stable at a voltage determined by the balance between a pull-up due to the capacitive coupling of parasitic capacitance Ci and a pull-down due to the current flowing in NMOS transistor 10.

At the end of phase I, after potential $V_{N2}$ of node N2 is pulled up due to the aforementioned capacitive coupling, while PMOS transistor 16 remains off, NMOS transistor 12 turns on weakly, so that a slight drop occurs. As a result, a peak is generated at the end of rise of power source voltage $V_{DD}$ (about 20 ns). Then, as NMOS transistor 12 turns off, node N2 has a high impedance, and potential $V_{2N}$ of node N2 is kept almost constant during the period of phase II. However, this is not the intrinsically stable state (stable state in saturation mode), and this voltage level is not the desired (steady-state) level.

On the side of PMOS transistor 14, even when it shifts to phase II, charging through resistor 18 to the parasitic capacitances lasts for a while. Consequently, source potential $V_{BIAS}$ is kept at a level slightly lower than power source voltage $V_{DD}$. However, as PMOS transistor 14 is on, source potential $V_{BIAS}$ approaches power source voltage $V_{DD}$.

On the other hand, as leakage current flows in MOS transistors 10–16, potential $V_{N2}$ of node N2 falls gradually, while potential $V_{N1}$ of node N1 rises gradually.

Then, in phase III, when potentials $V_{N1}$ and $V_{N2}$ of nodes N1 and N2 reach the prescribed critical level, that is, when the current flowing in MOS transistors 10–16, in particular, in diode-connected NMOS transistor 10 and PMOS transistor 16, increases to a prescribed critical level, NMOS transistor 10 and PMOS transistor 16, and, then NMOS transistor 12 and PMOS transistor 14, shift instantly to the operating point in the saturation region, and the potentials or voltages of the various portions reach the desired levels. In this way, in phase IV, a stable operating state, that is, steady state, is reached. At steady state, due to the current mirror circuit, current I is kept at a prescribed constant current value, and source potential $V_{BIAS}$ of PMOS transistor 14 is kept at a constant level below power source voltage $VV_{DD}$ by voltage drop on resistor 18 (IR).

In this embodiment, in phase I immediately after power on, capacitor 22 acts to pull up potential $V_{N1}$ at node N1 to the side of power source voltage $V_{DD}$ on the positive electrode side so as to cancel (or preferably to get over) parasitic capacitances Ce, Cf, Cg, Ch. on the other hand, capacitor 24 acts to pull down potential $V_{N2}$ at node N2 to the side of power source voltage $V_{SS}$ on the negative electrode side so as to cancel (or preferably exceed) parasitic capacitances Ca, Cb, Cc, Cd. As a result, it is able to increase the shifting speed of phases I, II, III and IV, and to induce to the stable operating point in the saturation mode at high speed.

In particular, in Application Example ② when capacitances C22 and C24 of the two capacitors are set to 0.1 pF, as shown in FIGS. 3 and 4, there is essentially no step corresponding to phases II and III (skipped), and it is possible to shift instantly from phase I (start-up) to phase IV (stable operation state), so that it is possible to realize ultra-high-speed start-up with high stability and at high precision.

Because it is possible to perform such ultra-high-speed start-up, this is a significant advantage for applications that require immediate operation directly after power on and for applications that require immediate switching from power-save mode (stand-by) to operating mode.

Also, there is little increase in the circuit area that accompanies the addition of start-up capacitors 22 and 24.

Figure 16:
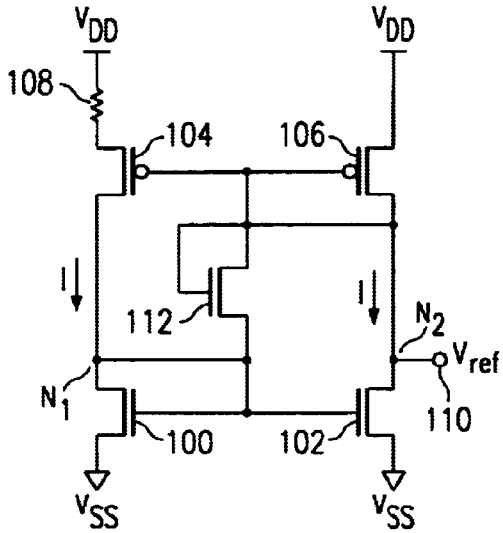
FIG. 16 (PRIOR ART)
FIG. 16 is a circuit diagram illustrating the constitution of the start-up circuit of a conventional reference voltage generator.

Also, because capacitors 22 and 24 automatically turn off by charging up, there is no need to consider the off state of the conventional start-up circuit (FIG. 16), and the device can be used at a low power source voltage. This feature is very beneficial for applications such as cell phones and portable terminals.

Figure 7:
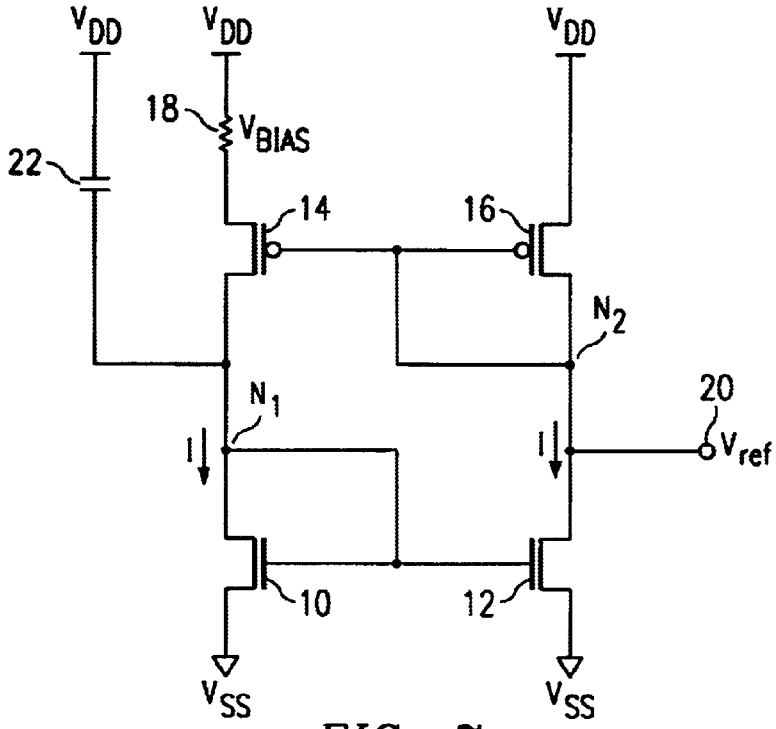
FIG. 7 is a circuit diagram illustrating the constitution of the reference voltage generator in a modified embodiment example.
Figure 8:
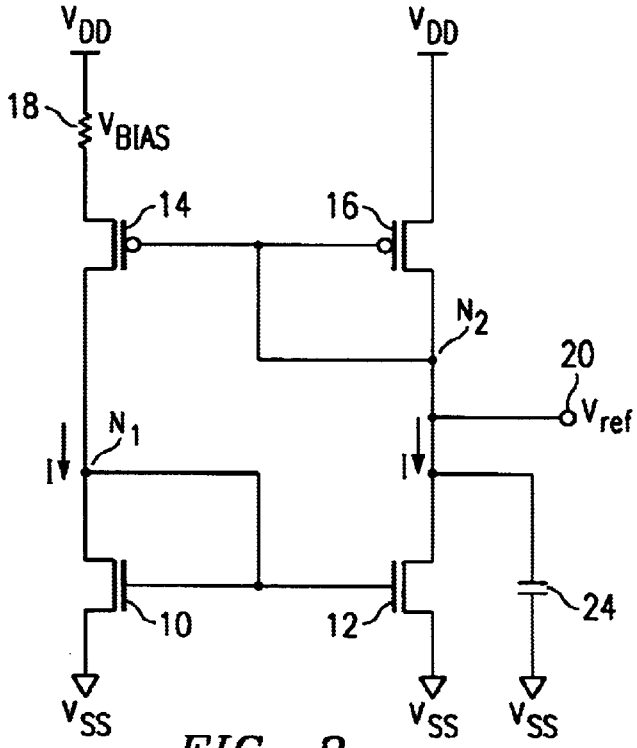
FIG. 8 is a circuit diagram illustrating the constitution of the reference voltage generator in another modified embodiment example.

FIGS. 7 and 8 illustrate constitutions of modified examples of said embodiment. In the modified example shown in FIG. 7, as the start-up circuit, only capacitor 22 is added, while capacitor 24 is omitted. In the modified example shown in FIG. 8, only capacitor 24 is added, while capacitor 22 is omitted.

Figure 9:
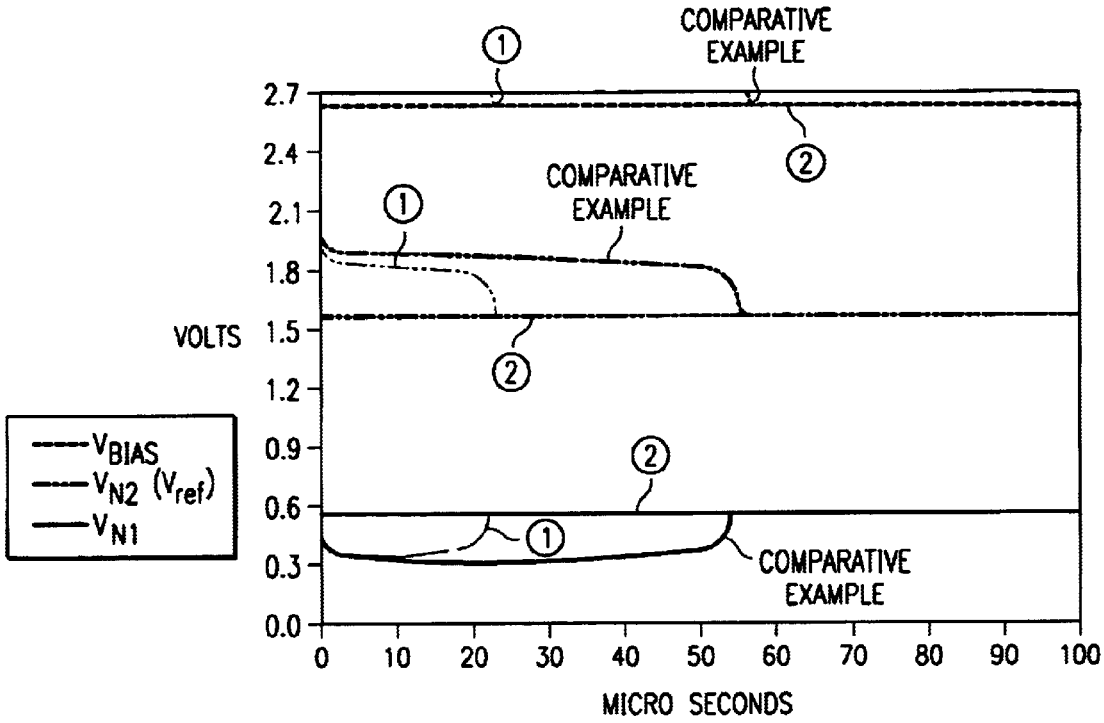
FIG. 9 is a diagram illustrating the voltage waveforms of the various portions at the time of start-up in the modified example shown in FIG. 8.
Figure 10:
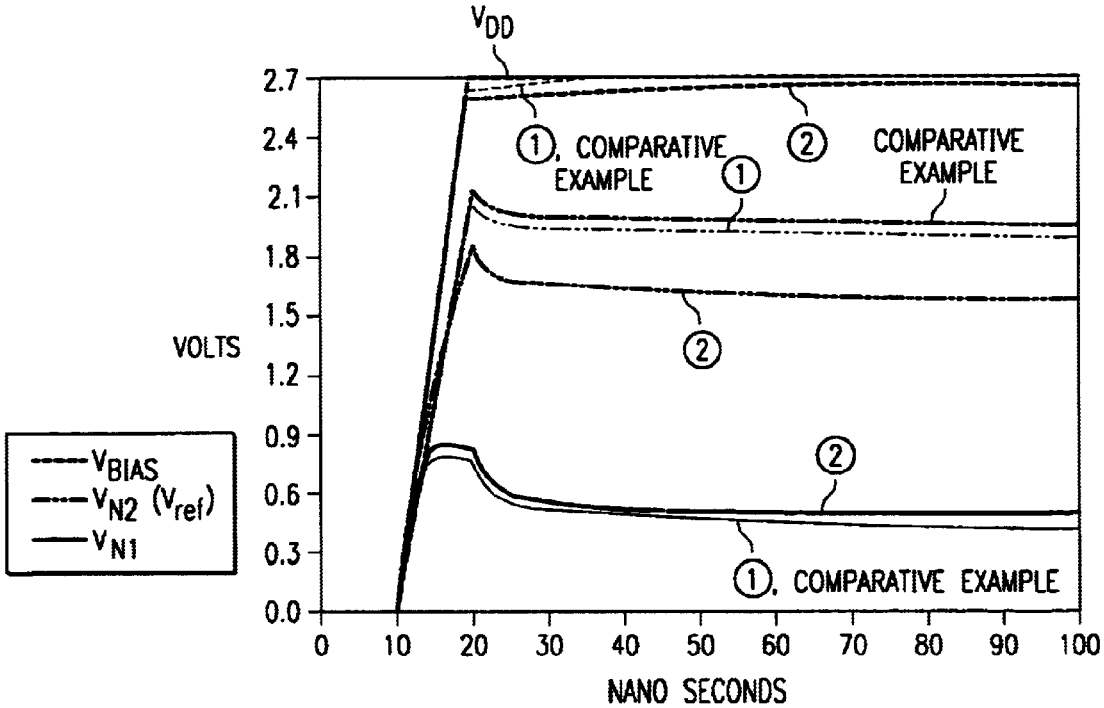
FIG. 10 is a diagram illustrating the voltage waveforms of the various portions immediately after start-up in the modified example shown in FIG. 8, with expanded time axis.

In the modified example illustrated in FIG. 7, the voltage waveforms (simulation) of the various portions at the time of start (0–100 μs) are shown in FIG. 9, and the voltage waveforms of the various portions immediately after start-up (0–100 ns) are shown in FIG. 10. The conditions of simulation are the same as those in the aforementioned embodiment. It can be seen that for the constitution having only capacitor 22 added, a start-up effect similar to that in the aforementioned embodiment can be realized.

In particular, in Application Example ②, as shown in FIG. 10, during rise (phase I), due to the capacitive coupling effect of capacitor 22, potential $V_{N1}$ of node N1, which is also the potential of gate/drain of NMOS transistor 10, rises to a higher peak potential (approximately 0.9 V), so that the speed for pulling down potential $V_{N2}$ of node N2 on the opposite side, which is also the potential of gate/drain of PMOS transistor 16, after the end of the rise becomes much faster. Also, although after the end of the rise, NMOS transistor 10 starts to turn on weakly, and potential $V_{N1}$ of node N1 decreases gradually, since capacitor 22 feeds charge to node N1 so that decrease in potential is suppressed and off of NMOS transistor 10 is significantly delayed.

Figure 11:
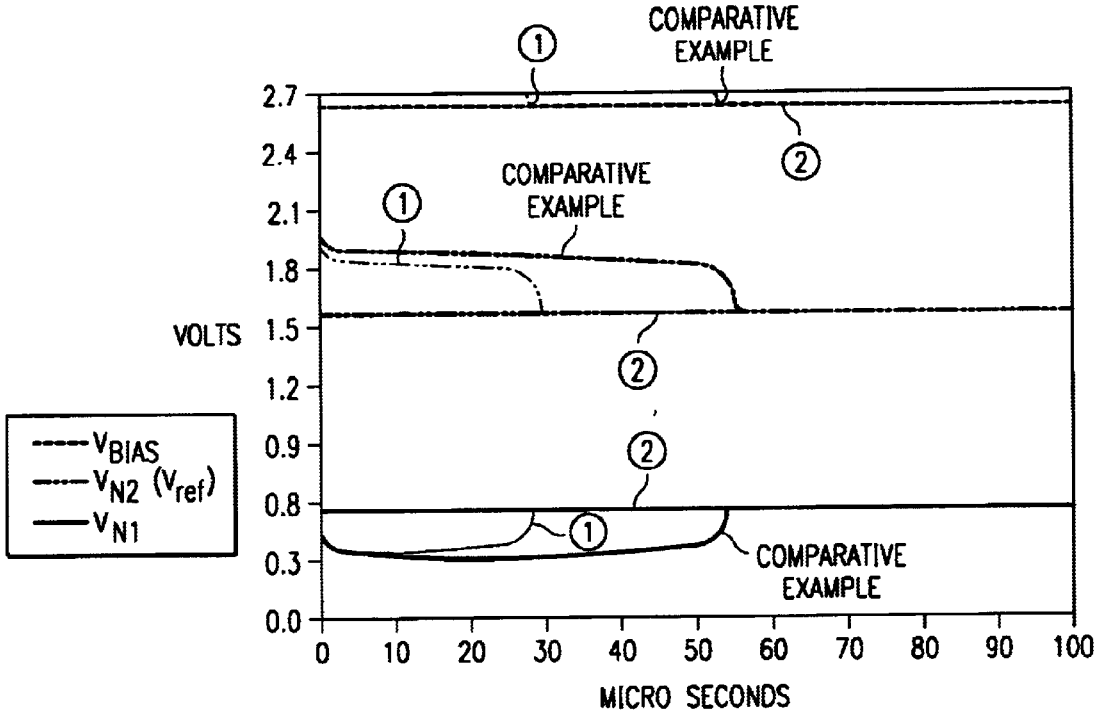
FIG. 11 is a diagram illustrating the voltage waveforms of the various portions at the time of start-up in the modified example shown in FIG. 9.
Figure 12:
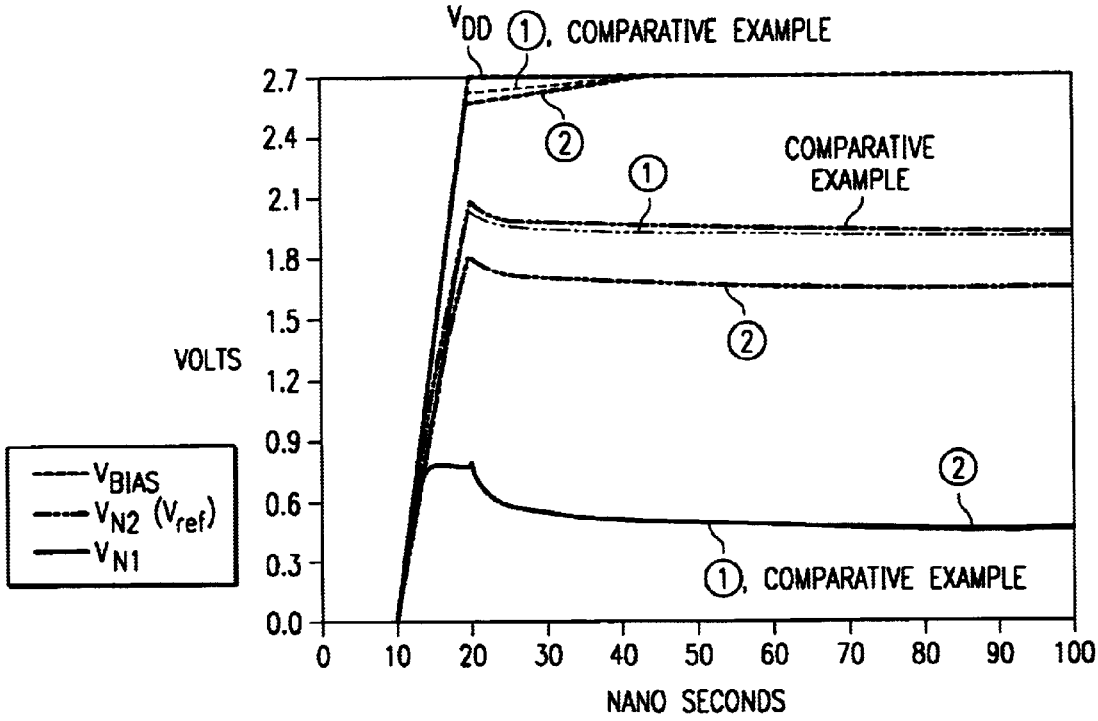
FIG. 12 is a diagram illustrating the voltage waveforms of the various portions immediately after start-up in the modified example shown in FIG. 9.

In the modified example illustrated in FIG. 8, the voltage waveforms (simulation) of the various portions at the time of start-up (0–100 μs) are shown in FIG. 11, and the voltage waveforms of the various portions immediately after start-up (0–100 ns) are shown in FIG. 12. The conditions of simulation are the same as those in the aforementioned embodiment. It can be seen that for the constitution having only capacitor 24 added, a start-up effect similar to that in the aforementioned embodiment can be realized.

In particular, in Application Example ②, as shown in FIG. 12, during rise (phase I), due to the capacitive coupling effect of capacitor 24, potential $V_{N2}$ of node N2, which is also the potential of gate/drain of PMOS transistor 16, is suppressed to a lower peak potential (approximately 1.8 V), so that the speed for pulling up potential $V_{N1}$ of node N1 on the opposite side, which is also the potential of gate/drain of NMOS transistor 10, after the end of the rise becomes much faster.

Figure 13:
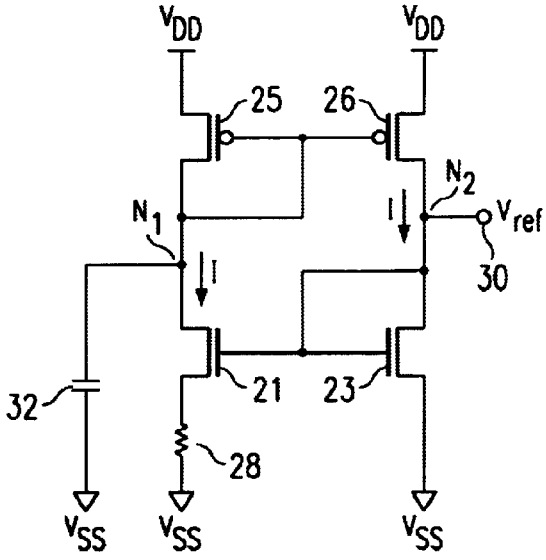
FIG. 13 is a circuit diagram illustrating the constitution of the reference voltage generator in another embodiment of the invention.

FIG. 13 illustrates the constitution of the reference voltage generator in another embodiment. In this reference voltage generator, the NMOS transistor and PMOS transistor of the reference voltage generator of the aforementioned embodiment play opposite roles, and it has offset circuit on the side of NMOS transistors 21, 23. More specifically, PMOS transistor 25 is connected as a diode, that is, the gate and drain are short-circuited to each other, and, at the same time, the source is directly connected to the terminal of power source voltage $V_{DD}$ on the positive electrode side. On the side of PMOS transistor 26, the gate is connected to the gate of PMOS transistor 25, and the source is directly connected to the terminal of power source voltage $V_{DD}$ on the positive electrode side. PMOS transistors 25, 26 form a current mirror circuit.

NMOS transistors 21, 23 form a current mirror circuit, and drain current I is fed to the current mirror circuit. The same drain current I flows in the current mirror circuit. NMOS transistor 23 is connected as a diode, that is, the gate and drain are short-circuited, and, at the same time, the source is directly connected to the terminal of power source voltage $V_{SS}$ on the negative electrode side. The gate/drain of NMOS transistor 23 are connected to the drain of PMOS transistor 26, and output terminal 30 is led out from the connecting point or node N2. The gate of NMOS transistor 21 is connected to the gate of NMOS transistor 23, the drain is connected to the gate/drain of PMOS transistor 25, and its source is connected via resistor 28 of the offset circuit to the terminal of power source voltage $V_{SS}$ on the negative electrode side.

In this embodiment, start-up capacitor 32 is connected between gate/drain of PMOS transistor 25, that is, node N1, and the terminal of power source voltage $V_{SS}$ on the negative electrode side. It is also possible to adopt a constitution in which a start-up capacitor (not shown in the figure) is connected between gate/drain of NMOS transistor 22 connected as a diode, that is, node N2, and the terminal of power source voltage $V_{DD}$ on the positive electrode side, instead of, or in addition to, said capacitor 32. In this embodiment, the same reference voltage generating function and the same start-up effect as those in the aforementioned embodiment can also be realized.

Figure 14:
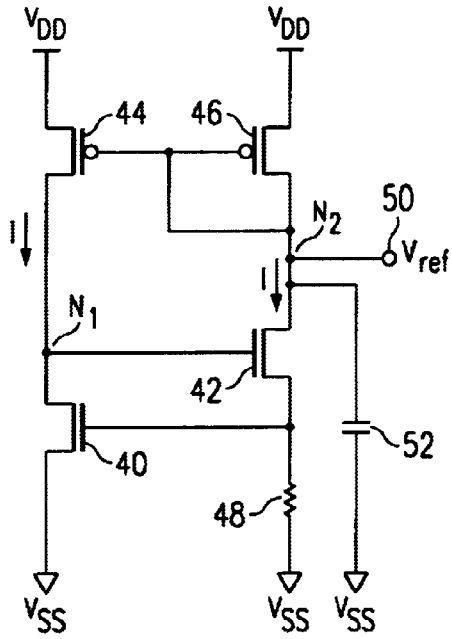
FIG. 14 is a circuit diagram illustrating the constitution of the reference voltage generator in yet another embodiment of the invention.
Figure 15:
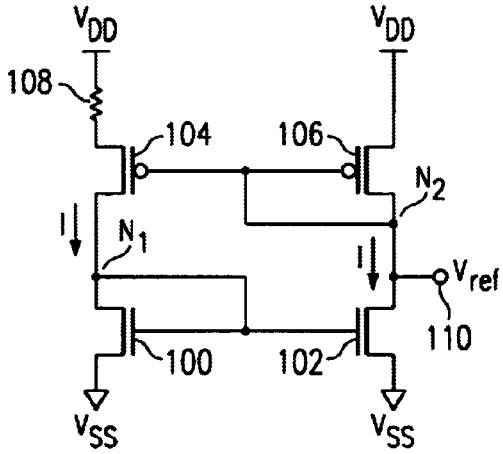
FIG. 15 (PRIOR ART)
FIG. 15 is a circuit diagram illustrating the constitution of a conventional reference voltage generator.

FIG. 14 illustrates the constitution of the reference voltage generator in another embodiment of this invention. This reference voltage generator is a so-called threshold reference type, which gives an offset or bias corresponding to the difference in threshold between NMOS transistors 40 and 42 at the gates of said two NMOS transistors with the offset function. In this reference voltage generator, PMOS transistors 44, 46 form a current mirror circuit. More specifically, PMOS transistor 46 is diode-connected, that is, its gate is short-circuited to its drain, and, at the same time, its source is directly connected to the terminal of power source voltage $V_{DD}$ on the positive electrode side. on the side of PMOS transistor 44, its gate is connected to the gate of PMOS transistor 46, and its source is directly connected to the terminal of power source voltage $V_{DD}$ on the positive electrode side.

The gate of NMOS transistor 40 is connected to the source of NMOS transistor 42, the source is directly connected to the terminal of power source voltage $V_{SS}$ on the negative electrode side, and the drain is connected to the drain of PMOS transistor 44. The gate of NMOS transistor 44 is connected to the drain of NMOS transistor 40, the source is connected via resistor 48 to the terminal of power source voltage $V_{SS}$ on the negative electrode side, and the drain is connected to the gate/drain of PMOS transistor 46. Also, output terminal 50 is led out from the drain of NMOS transistor 42, that is, from node N2.

In this embodiment, start-up capacitor 52 is connected between the gate/drain of PMOS transistor 46 connected as a diode and the terminal of power source voltage $V_{SS}$ on the negative electrode side. In this embodiment, the same reference voltage generating function as that in the aforementioned embodiment is also displayed, and the same start-up function is realized.

In the aforementioned embodiment, output terminal 20, 30 or 50 is led out from node N2. However, it is also possible to adopt a constitution in which the output terminal is led out from node N1 on the opposite side.

The reference voltage generator of this invention can be adopted in various applications, such as an operational amplifier, PLL circuit, DLL circuit, D/A converter, A/D converter, LCD driver, etc. In principle, it can be used in any application that uses a reference voltage with a prescribed voltage level.

As explained above, the reference voltage generator of this invention has a fast start-up speed and operates with high stability and high precision, without substantially increasing the circuit area, even with a low-power source voltage.

What is claimed is:

1. A reference voltage generator comprising a MOS transistor having a gate short-circuited to its drain and a source connected to a first power source voltage terminal that provides a first potential, a capacitor connected between the gate/drain of the MOS transistor and a second power source voltage terminal that provides a second potential, and an output terminal connected to a prescribed node in the circuit; wherein the MOS transistor operates in a saturated state, and a reference voltage at a prescribed level is output from the output terminal.

2. The reference voltage generator described in claim 1 further comprising a current mirror circuit for setting prescribed current in the MOS transistor at the node.

3. The reference voltage generator described in claim 2 wherein the current mirror circuit contains the MOS transistor.

4. A reference voltage generator comprising a first MOS transistor of a first conductivity type having a gate short-circuited to its drain and a source connected to a first power source voltage terminal that provides a first potential, a second MOS transistor of the first conductivity type having a gate connected to the gate of the first MOS transistor and a source connected to the first power source voltage terminal so as to form a current mirror circuit together with the first MOS transistor, a third MOS transistor of a second conductivity type having a drain connected to the drain of the first MOS transistor and a source connected to a second power source voltage terminal that provides a second potential, a fourth MOS transistor of the second conductivity type having a drain connected to the drain of the second MOS transistor and a source connected to the second power source voltage terminal, an offset circuit for providing voltage offsets to the gate source voltage of the third MOS transistor and the fourth MOS transistor, respectively, a first capacitor connected between the gate/drain of the first MOS transistor and the second power source voltage terminal, and a reference voltage output terminal connected to the drain of the first MOS transistor or the second MOS transistor.

5. The reference voltage generator described in claim 4 wherein the offset circuit contains a resistor connected between the second power source voltage terminal and the source of the third MOS transistor or the source of the fourth MOS transistor.

6. The reference voltage generator described in claim 5 further comprising a second capacitor connected between the gate/drain of the fourth MOS transistor and the first power source voltage terminal.

7. The reference voltage generator described in claim 4 wherein the gates of the third MOS transistor and the fourth MOS transistor are connected; and that the gate of the fourth MOS transistor is short-circuited to its drain.

8. The reference voltage generator described in claim 7 wherein the gate of the third MOS transistor is connected to the drain of the fourth MOS transistor; and that the gate of the fourth MOS transistor is connected to the source of the third MOS transistor.

9. The reference voltage generator described in claim 7 wherein the offset circuit contains a resistor connected between the second power source voltage terminal and the source of the third MOS transistor or the source of the fourth MOS transistor.

10. The reference voltage generator described in claim 7 further comprising a second capacitor connected between the gate/drain of the fourth MOS transistor and the first power source voltage terminal.

11. The reference voltage generator described in claim 4 wherein the gate of the third MOS transistor is connected to the drain of the fourth MOS transistor; and that the gate of the fourth MOS transistor is connected to the source of the third MOS transistor.

12. The reference voltage generator described in claim 11 further comprising a second capacitor connected between the gate/drain of the fourth MOS transistor and the first power source voltage terminal.

13. The reference voltage generator described in claim 4 further comprising a second capacitor connected between the gate/drain of the fourth MOS transistor and the first power source voltage terminal.

* * * * *